US005996655A

United States Patent [19]

Cramond et al.

[11] Patent Number: 5,996,655

[45] Date of Patent: Dec. 7, 1999

[54] PIVOTING KNIFE CLAMP

[75] Inventors: Patrick J. Cramond, West Vancouver; Michael J. Dunne, North Vancouver, both of Canada

[73] Assignee: CAE Machinery Ltd., Vancouver, Canada

[21] Appl. No.: 08/989,143

[22] Filed: Dec. 11, 1997

[51] Int. Cl.[6] ..... B27C 1/00; B27C 13/00

[52] U.S. Cl. ..... 144/176; 144/162.1; 144/229; 241/298; 241/92; 407/111

[58] Field of Search ..... 144/162.1, 172, 144/174, 176, 218, 229, 230, 241, 232, 233, 234; 241/92, 298; 407/40, 41, 47, 49, 102, 111

[56] References Cited

U.S. PATENT DOCUMENTS

| | | | |
|---|---|---|---|
| 1,713,066 | 5/1929 | Wolf . | |
| 3,500,522 | 3/1970 | Stier | 407/111 |
| 3,693,224 | 9/1972 | Bartoszevicz | 407/111 |
| 3,865,164 | 2/1975 | Sybertz . | |
| 4,047,670 | 9/1977 | Svensson | 241/298 |
| 4,220,186 | 9/1980 | Sybertz | 144/174 |
| 4,298,044 | 11/1981 | Hansel et al. . | |
| 4,321,846 | 3/1982 | Neamtu | 407/111 |
| 4,355,673 | 10/1982 | Köstermeier . | |
| 4,594,928 | 6/1986 | Thomas et al. . | |
| 4,685,497 | 8/1987 | Mierau et al. . | |
| 4,771,718 | 9/1988 | Carpenter et al. . | |
| 4,784,337 | 11/1988 | Nettles et al. . | |
| 4,794,961 | 1/1989 | Bonac . | |
| 5,348,064 | 9/1994 | Nettles et al. | 144/176 |
| 5,469,902 | 11/1995 | Sharp et al. | 144/176 |
| 5,649,579 | 7/1997 | Kokko et al. | 144/176 |
| 5,685,672 | 11/1997 | Tjernstrom | 407/111 |

*Primary Examiner*—W. Donald Bray
*Attorney, Agent, or Firm*—Townsend and Townsend and Crew LLP

[57] ABSTRACT

An improved system for clamping and retaining a cutting knife in position in an apparatus for processing wood. The apparatus includes a support surface, a cutting knife, an associated holding location on the support surface to receive the cutting knife, and a clamp member having a clamping surface to engage and hold the at least one cutting knife in the associated holding location. The improvement involves mounting the clamp member to the support surface at a pivot joint for pivotal movement of the clamp member with respect to the support surface. The clamp member has a clamping surface that extends on one side of the pivot joint and a lever arm extending on the other side of the pivot joint. An actuating member is provided to apply a force to the lever arm so that a clamping force is applied to the cutting knife through the clamping surface according to the principle of a first order lever. The pivoting clamping arrangement provides secure and reliable clamping of the cutting knives. The pivoting joint between the clamp member and the support surface tend to evenly distribute the clamping force along the length of the cutting knife for better retention of the knife.

23 Claims, 6 Drawing Sheets

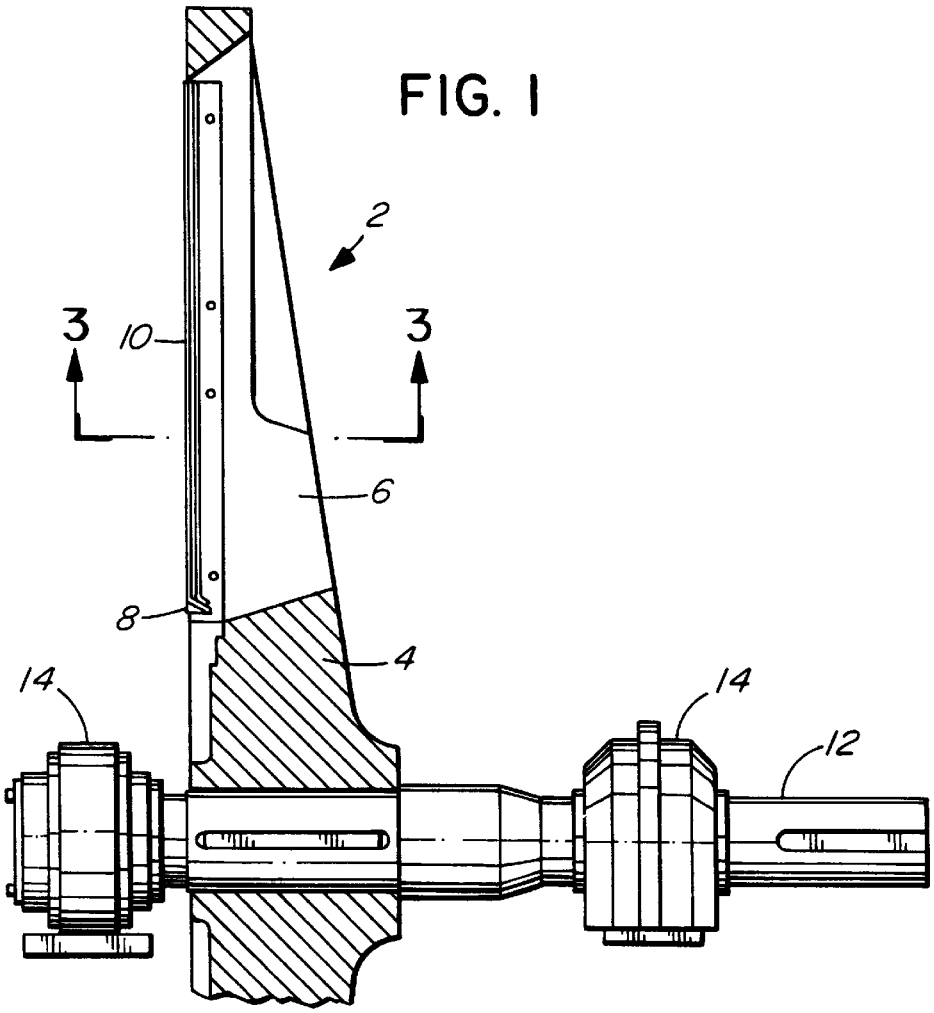
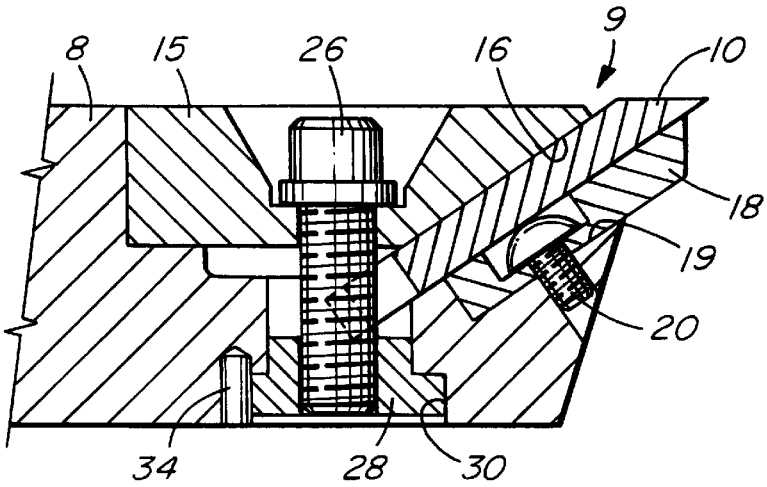
FIG. 2a PRIOR ART

PIVOTING KNIFE CLAMP

FIELD OF THE INVENTION

This invention relates generally to apparatus for processing wood using cutting knives and, more particularly, to a knife clamping system for retaining removable cutting knives in place on the apparatus for processing wood.

BACKGROUND OF THE INVENTION

Apparatus for processing wood are well known. Such apparatus is used to convert wood, in the form of raw logs or boards, into wafers, chips or strands for use in various types of composite boards, paper or the like.

Wood processing apparatus generally employ a large rotating disc or ring mounted on a driven shaft. A series of cutting knives are mounted to the disc face or about the inner or outer periphery of the ring, often by bolts. The rotating disc or ring is positioned adjacent to a chamber for holding logs. The disc or ring can be stationary or mounted to a carriage that allows the rotating disc or ring to be slowly advanced through the logs in the chamber. The rotating knives convert the wood into wafers, or strands that are collected and conveyed away below the carriage. The carriage then retracts allowing a new batch of logs to be delivered to the chamber for processing.

In wood processing apparatus of this type, the knives need to be regularly maintained. The knives can be either re-useable or a disposable design. Re-usable knives are generally made from plate steel. Even with scheduled maintenance, knives can be damaged during normal use and it is important to be able to replace the knives as quickly as possible to minimize down time and lost production.

At present, most knives are mounted to the disc or ring by a carrier member and a clamp member. Each knife comprises an elongated blade member having a cutting edge. The carrier member is mounted to the disc or ring, sometimes via a carrier support. The carrier member provides a surface to receive an elongate knife blade. The knife blade is sandwiched between the carrier member and the clamp member and the clamp member is held against the knife blade by a series of locating bolts that extend through the clamping member and into the carrier or carrier support, ring or disc. In this arrangement, the clamping member and carrier member co-operate to act as a third order lever.

To maintain a relatively consistent clamping force, the clamping member is formed as thick and stiff as possible so that the number of locating bolts can be kept to a minimum. At the same time, due to the limited space in many wood processing apparatus, the thickness of the clamping member is limited and clamping bolts must be close together to ensure reliable clamping of the knife blade on the carrier by the clamping member. The more locating bolts that are necessary to locate the clamping member, the greater the time to replace worn or damaged knife blades.

SUMMARY OF THE INVENTION

The present invention provides a knife clamping arrangement for wood processing equipment that uses a pivoting clamp member and an actuating member that co-operate to apply a clamping force to the cutting knives according to the principle of a first order lever. The pivoting clamp arrangement of the present invention can use threaded fasteners as the actuating members, and when such fasteners are used, fewer or smaller fasteners are necessary for securing the clamp member to apply the same clamping force on the knife blade as compared with conventional clamping systems.

The present invention provides an improved knife clamping system for use in an apparatus for processing wood that includes a support surface;

at least one cutting knife;

an associated holding location on the support surface to receive the at least cutting knife; and a clamp member having a clamping surface to engage and hold the at least one cutting knife in the associated holding location. The improvement of the present invention comprises the clamp member being mountable to the support surface at a pivot joint for pivotal movement of the clamp member with respect to the support surface, the clamping surface of the clamp member extending on one side of the pivot joint and the clamp member having a lever arm extending on the other side of the pivot joint. As well, the pivoting clamp arrangement of the present invention relies on an actuating member to apply a force to the lever arm of the clamp member so that a clamping force is applied to the at least one cutting knife through the clamping surface according to the principle of a first order lever.

In a further aspect, the present invention provides a knife clamping system for holding a cutting knife in position against a support surface comprising:

a clamp member having a clamping surface to engage and hold the cutting knife against the support surface;

a mounting location on the support surface to receive the clamp member, the mounting location and the clamp member co-operating to form a pivot joint for pivotal movement of the clamp member with respect to the support surface, the clamping surface of the clamp member extending on one side of the pivot joint and the clamp member having a lever arm extending on the other side of the pivot joint; and an actuating member to apply a force to the lever arm so that a clamping force is applied to the cutting knife by the clamping surface according to the principle of a first order lever.

The actuating member of the present invention can include, but is not limited to, threaded fasteners, wedge elements, expandable pressure hoses, coil springs and cam mechanisms which are positioned between the support surface and the lever arm of the clamp member.

In addition, the pivotable joint between the clamp member and the support surface tends to evenly distribute the clamping force along the length of the cutting knife for better retention of the knife.

BRIEF DESCRIPTION OF THE DRAWINGS

Aspects of the present invention are illustrated, merely by way of example, in the accompanying drawings in which:

FIG. 1 is a section view through a cutting disc that can be fitted with the pivoting clamping system of the present invention;

FIGS. 2*a*, 2*b* and 2*c* are detail section views of conventional prior art clamping arrangements for cutting knifes that all operate on the principle of a third order lever;

DESCRIPTION OF THE PREFERRED EMBODIMENTS

Figure 2B:
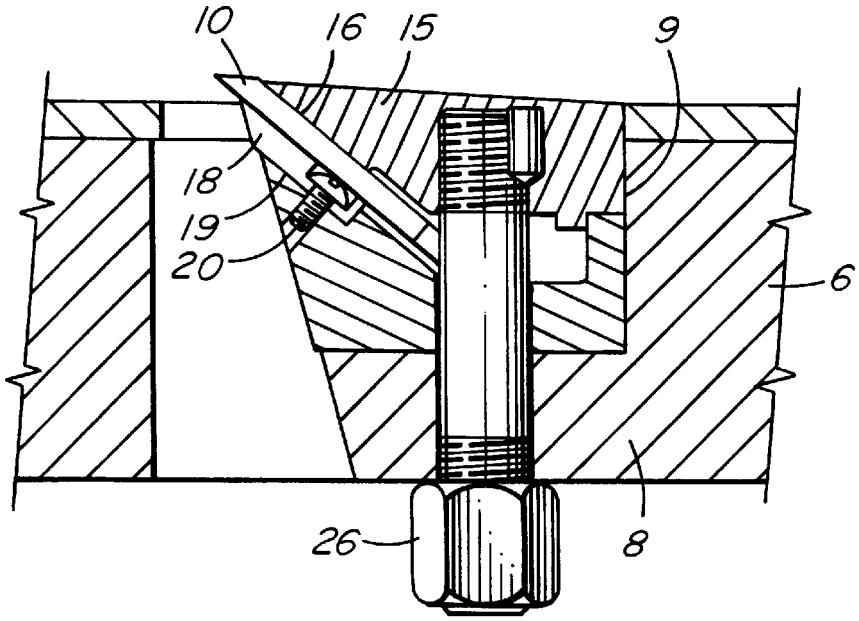
FIG. 2b PRIOR ART

The pivoting knife clamp arrangement of the present invention is suitable for use with any wood processing equipment that employs a knife that is held in place by a clamping member. As such, the knife clamping arrangement of the present invention can be used on chipping, flaking or waferizing equipment that employs a rotary disc or ring or similar rotary member.

By way of example, FIG. 1 is a general view of a disc waferizing apparatus 2 to establish the design and component parts of a wood processing apparatus suitable for use with the pivoting clamping arrangement of the present invention. FIG. 1 is a partial cross-section through a rotatable disc 4 having spaced, radially extending openings 6 through the disc. Each opening has a support surface in the form of a knife carrier 8 to receive longitudinal cutting knife 10. Disc 4 is mounted on a rotatable shaft 12 carried by bearings 14. Rotating disc 4 contacts with wood (usually lumber, logs or cut sections of logs) to be processed and cutting knives 8 convert the wood into wafers that exit the rear of the disc through openings 6.

Figure 2C:
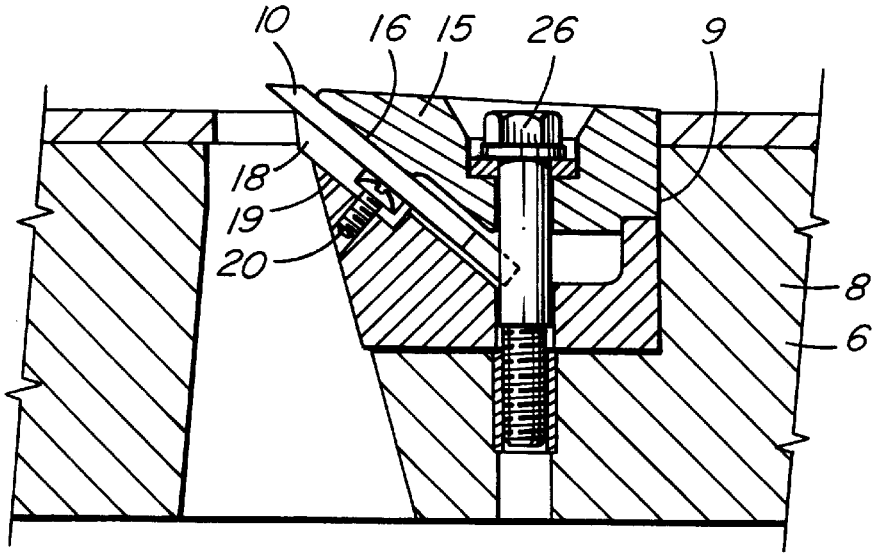
FIG. 2c PRIOR ART

FIGS. 2*a*, 2*b* and 2*c* are detail section views of prior art holding locations taken generally along line 3—3 of FIG. 1. In each of the prior art designs, there is a knife carrier 8 that is mounted to the rotatable disc 4 and includes a holding location 9 comprising a depressed cavity to receive knife 10 and associated clamping equipment. There is a clamp member 15 having an inclined surface 16 to abut knife 10. Knife 10 is mounted on a counter knife 18 located in position by bolt 20. Counter knife 18 abuts inclined surface 19 of the holding location.

In FIG. 2*a*, an arrangement for a flaker in shown in which clamp member 15 is shaped to be flush with the front face of the knife carrier when installed in place. A threaded fastener 26 engages threaded member 28 received within recess 30 in knife carrier 8. Knife carrier 8 is mounted to the flaker disc in a conventional manner (not shown). A pin 34 is provided to prevent rotation of threaded member 28. By tightening fastener 26 into threaded member 28, clamp member 15 is forced into contact with the assembly of knife 10 and counter knife 18 to clamp the knife package to knife carrier 8.

The clamping arrangements of FIGS. 2*b* and 2*c* are intended for use in chipping equipment where it is desirable for clamp member 15 to project slightly outwardly from the knife carrier 8. The arrangement of FIG. 2*b* employs a threaded fastener 26 that extends through the rear face of the disc 6 and the knife carrier 8 to engage and hold clamp member 15. The arrangement of FIG. 2*c* has a fastener 26 that extends through the clamp member, the knife carrier 8 for engagement in disc surface 6.

All of the foregoing prior art clamping arrangements operate on the principle of a third order lever.

Figure 3:
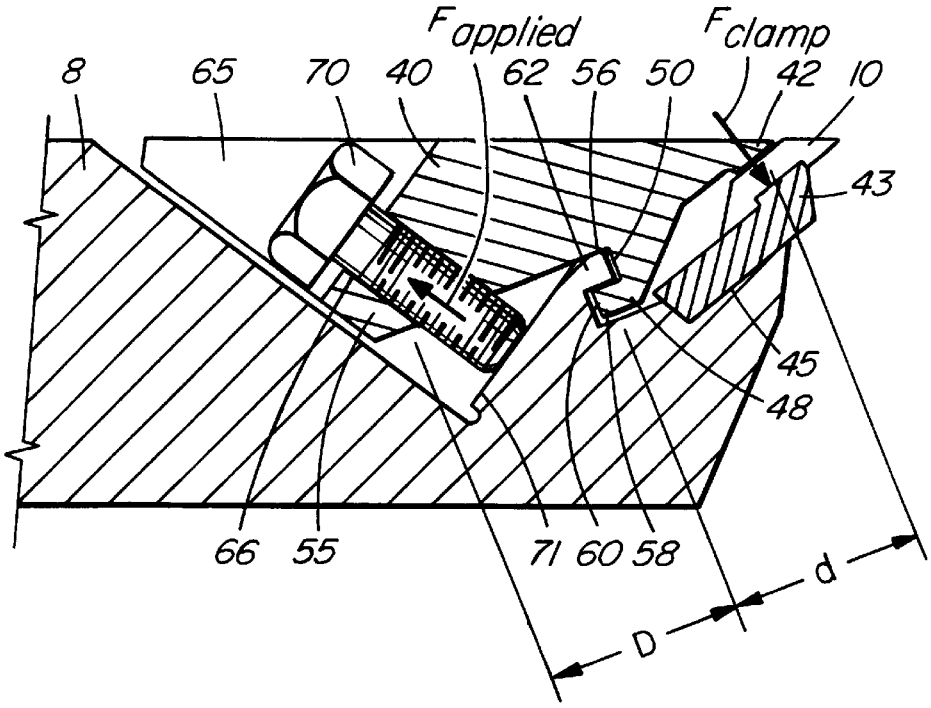
FIG. 3 is a detail section view taken along line 3—3 of FIG. 1 of a first embodiment of the pivoting clamping system of the present invention that uses a threaded fastener extending through the lever arm as the actuating member.

Applicant has developed an alternative pivoting clamping arrangement that is illustrated in a first embodiment in FIG. 3. In the embodiments that are described below, the illustrated cutting knives 10 are of a disposable type. It will be apparent to a person skilled in the art that the clamping arrangement of the present invention will readily accommodate re-useable cutting knives also. In the clamping arrangement of the present invention, holding location 9 in knife carrier 8 is modified to accommodate the unique pivoting clamp member 40 and the actuating member of the present invention.

Clamp member 40 has a clamping surface 42 to engage and hold the upper surface of cutting knife 10. The lower surface of the cutting knife is braced, directly or indirectly, against the support surface defined by knife carrier 8. Preferably, knife 10 engages against counter knife 43 which, in turn, is positioned against angled surface 45 of knife carrier 8.

Clamp member 40 is mountable to knife carrier 8 at a mounting location 48. Mounting location 48 and clamp member 40 co-operate to define a pivot joint 50 for pivotal movement of the clamp member with respect to the knife carrier 8. Referring to FIG. 3, clamping surface 42 of clamp member 40 extends on one side of pivot joint 50, and the clamp member is also formed with an oppositely extending lever arm portion 55 that extends on the other side of pivot joint 50. The overall shape of clamp member 40 is determined by the need for the clamp member to perform its function as part of a lever and to fit within holding location 9. In the case of a flaking equipment, the overall shape of clamp member 40 is such that the upper surface 58 of the clamp member is substantially level with the surface of knife carrier 8 as illustrated in FIG. 3. In the case of chipping equipment, the clamp member would be shaped to project above the knife carrier 8.

Preferably, pivot joint 50 is defined by a channel 56 and flange 58 formed on the clamp member and a corresponding channel 60 and flange 62 formed on the support surface, the flange of one member engaging in the channel of the other to define a pivotable connection that extends the length of the knife holder 8. It will be apparent to those skilled in the art that other pivotable joint arrangements are possible.

Clamp member 40 is designed to be sufficiently stiff and robust to withstand the loads and moments it will experience during wood processing operations. The clamp member must also be able to withstand impact loads as the knives are rotated into logs. In general, the clamp member will be required to maintain a clamp load at clamping surface 42 in the range of 500–2000 pounds per linear inch of the knife.

In order to adjust the position of clamp member 40, an actuating member is provided to apply a force to lever arm portion 55. The result is the application of a clamping force to cutting knife 10 by clamping surface 42 according to the principle of a first order lever. Referring to FIG. 3, the clamping force exerted by clamping surface 42 at knife 10 is governed by the formula:

$$F_{clamp} = F_{applied}\left(\frac{D}{d}\right)$$

where $F_{applied}$ = the applied force $F_{clamp}$ = the clamping force $D$ = perpendicular distance of the applied force's line of action from the pivot joint $d$ = perpendicular distance of the clamping force's line of action from the pivot joint.

It will be readily apparent that by adjusting the distances D and d, it is possible to generate a clamping force that a multiple of the force applied by the actuator member.

In the embodiment of FIG. 3, lever arm 55 of clamp member 44 is formed with a plurality of cavities 65 along the length of the clamp. FIG. 3 is a section view through a typical cavity. Each cavity 65 includes a threaded aperture 66 that extends through lever arm 55. In this embodiment, the actuator member is a threaded fastener 70 that is installable into aperture 66 to bear against the knife holder 8 at surface 71. In this arrangement, fastener 70 is accessible from the front face of disc 4. Tightening of fastener 70 against surface 71 applies a force at lever arm 55 that results in a clamping force being applied at clamping surface 42.

Figure 4:
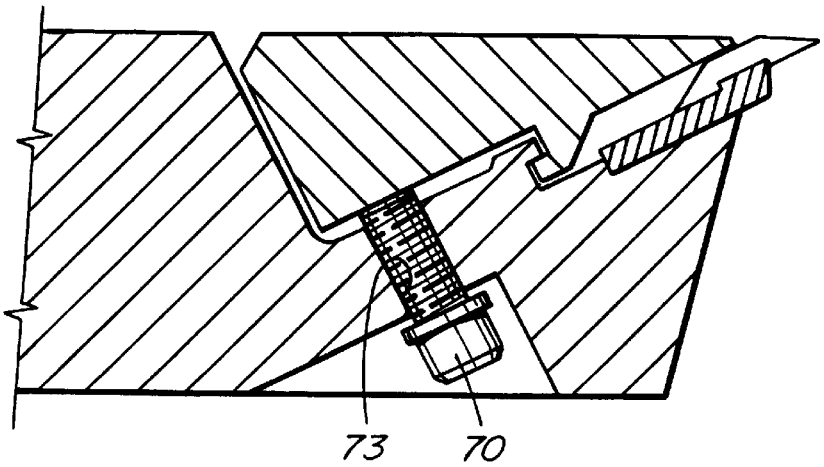
FIG. 4 is a detail section view similar to that of FIG. 3 showing a further embodiment of the pivoting clamping system of the present invention that uses a threaded fastener extending through the support surface as the actuating member.

FIG. 4 shows a second embodiment of the pivoting clamping arrangement of the present invention. In FIG. 4 and the subsequent figures illustrating further embodiments, identical features to those found in the first embodiment of FIG. 3 are labelled with the same reference numbers. In the embodiment of FIG. 4, the actuator member is again a threaded fastener 70, but in this case the fastener is positioned to be accessible from the rear face of disc 4. A plurality of threaded holes 73 are formed through the rear of knife carrier 8 along the length of the carrier. Each hole is adapted to receive fastener 70 so that the end of the fastener bears directly against lever arm 55 of clamp member 40.

Figure 5:
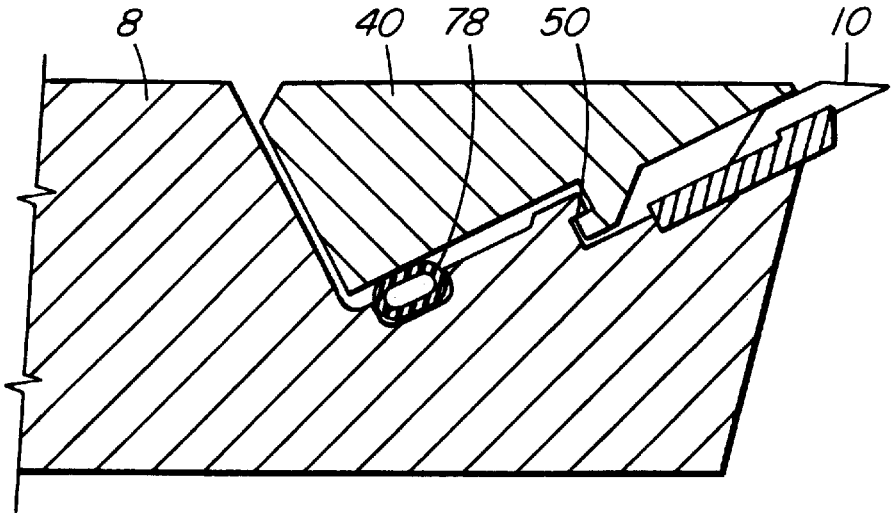
FIG. 5 is a detail section view similar to that of FIG. 3 showing a further embodiment of the pivoting clamping system of the present invention that uses a hydraulic hose between the support surface and the lever arm as the actuating member.

A third embodiment is shown in FIG. 5 using an alternative actuator member. In this embodiment, the actuator member is a resilient sealed enclosure 78 positioned between the knife carrier 8 and lever arm portion 55 of clamp member 40. Enclosure 78 is in communication with a pressure source (not shown) that permits the enclosure to be expanded to apply a force to the lever arm. Preferably, enclosure 78 is manipulated by the controlled introduction of fluid under pressure. Enclosure 78 can be dimensioned to extend along the entire length of knife carrier 8 to allow for a force to be applied along the entire length of knife 10 through clamping surface 40.

Figure 6A:
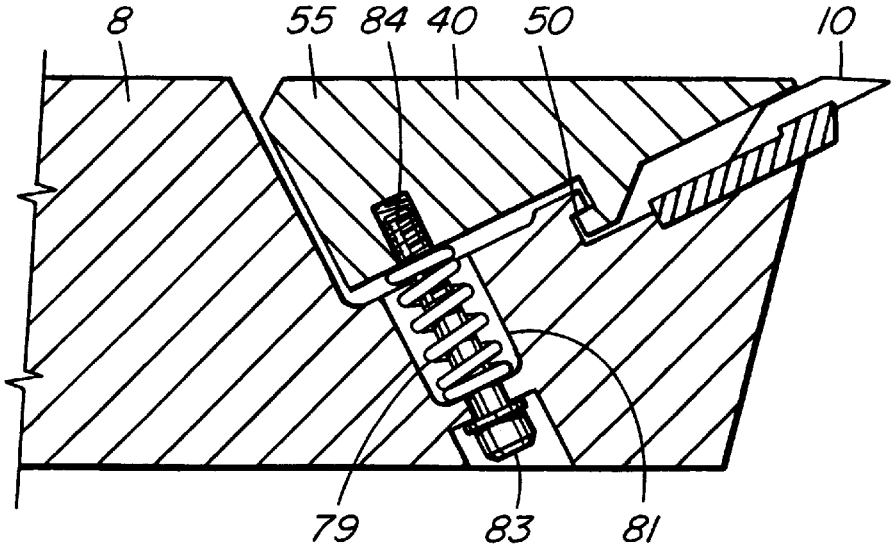
FIG. 6*a* is a detail section view similar to that of FIG. 3 showing a further embodiment of the pivoting clamping system of the present invention that uses a coil spring between the support surface and the lever arm as the actuating member.
Figure 6B:
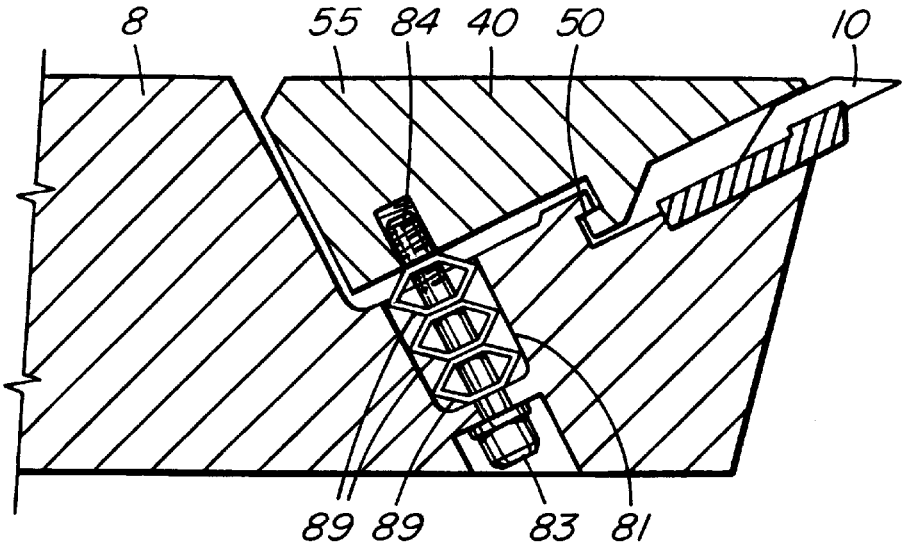
FIG. 6*b* is a detail view similar to that of FIG. 6*b* showing a plurality of spring washers co-operating to form a spring member that acts as the actuating member.

A fourth embodiment is shown in FIG. 6*a* in which the actuator member is a spring biasing member 79 positioned between the knife holder 8 and the lever arm of the clamp member. The spring biasing member illustrated is a coil spring 79 that is housed in a cavity 81. Alternatively, as illustrated in FIG. 6*b*, the spring biasing member can be a plurality of stacked spring washers 89 (also known as Belleville washers) positioned in cavity 81. Each spring washer is of generally conical shape having relatively large diameter base that tapers to a smaller diameter top with a central opening. The spring washers are preferably stacked base to base within cavity 81 as shown. In general, spring washers function best under conditions requiring high load in confined spaces or short travel, and therefore, work well in the environment of cavity 81. Preferably, a bolt 83 extends through the rear face of knife carrier 8 and extends up the centre of the spring biasing member to engage in threaded hole 84 in the underside of lever arm 55 of the clamp member 40. Bolt 83 is tightenable into hole 84 to draw lever arm 55 toward knife carrier 8 thereby compressing the biasing member and permitting release of knife 10. When bolt 83 is loosened from hole 84, the biasing member is able to apply a force to clamp member 40 to pivot the clamp member about joint 50 to clamp knife 10 in place. Bolt 83 and cavity 81 also co-operate to prevent buckling of the spring 79 or stacked spring washers 89 acting as the biasing member.

Figure 7:
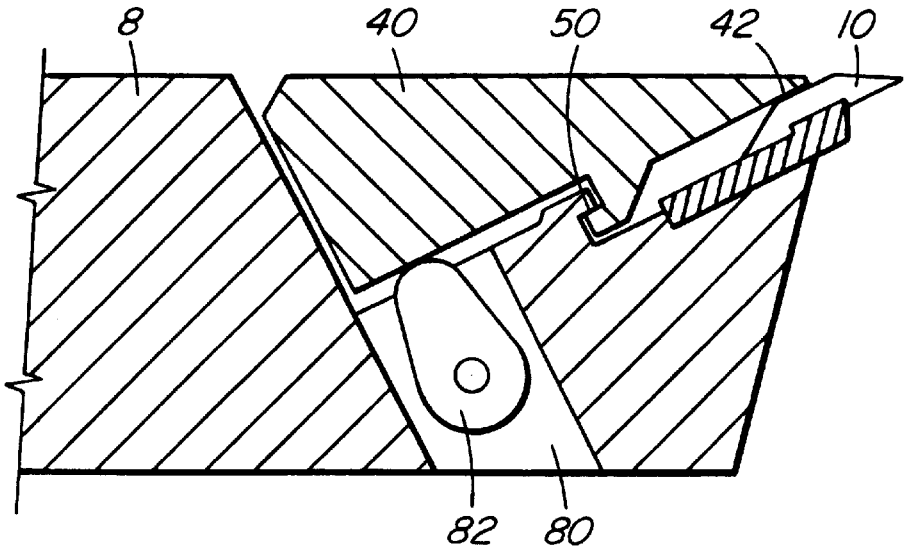
FIG. 7 is a detail section view similar to that of FIG. 3 showing a further embodiment of the pivoting clamping system of the present invention that uses a cam member between the support surface and the lever arm as the actuating member.

A fifth embodiment of the invention is illustrated in FIG. 7. The knife holder 8 is formed with a cavity 80 that houses a cam member 82 pivotally anchored to the knife carrier so that the cam can be rotated to engage the lever arm to apply a clamping force at clamping surface 42.

Figure 8:
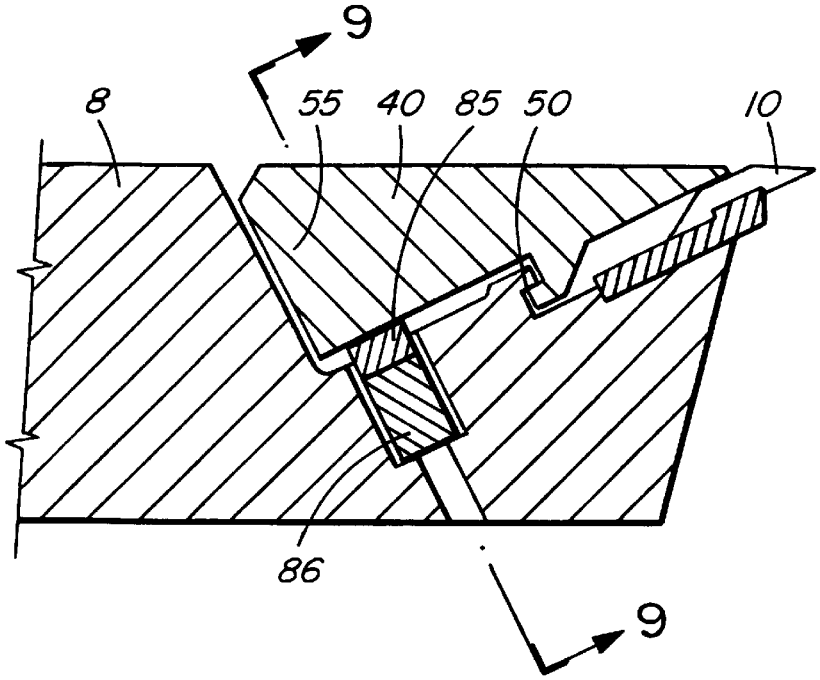
FIG. 8 is a detail section view similar to that of FIG. 3 showing a still further embodiment of the pivoting clamping system of the present invention that uses a wedge element between the support surface and the lever arm as the actuating member.
Figure 9:
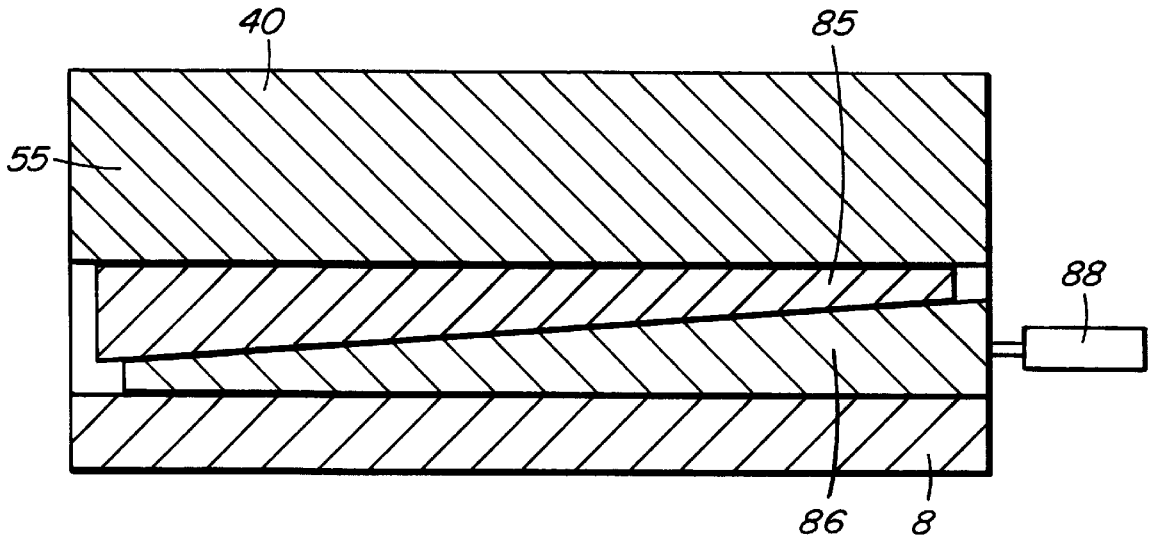
FIG. 9 is a section view taken along line 9—9 of FIG. 8 showing further details of the wedge element.

Referring to FIGS. 8 and 9, there is shown a sixth embodiment of the present invention that uses a pair of upper and lower opposed elongate wedge elements 85 and 86 as the actuator member. FIG. 9 is a section view taken along line 9—9 of FIG. 8 to show the wedge elements extending longitudinally between knife carrier 8 and lever arm 55. In a manner similar to the sealed enclosure 78 actuator of FIG. 5, this wedge element arrangement allows for a force to be applied along the entire length of the clamp member 40 and hence along the entire length of knife 10 through clamping surface 40. This will tend to provide a better grip of knife 10 than an arrangement that employs discrete, spaced actuators along the length of knife holder 8 such as are shown in previous embodiments. Referring to FIG. 9, an actuator 88 is provided to apply a longitudinal force to one of the wedge elements in order to position the wedges to apply a force on lever arm 55. Actuator 88 can be the piston of a hydraulic ram or the extendable threaded arm of a jack.

Although the present invention has been described in some detail by way of example for purposes of clarity and understanding, it will be apparent that certain changes and modifications may be practised within the scope of the appended claims.

We claim:

1. In an apparatus for processing wood having a support surface;

at least one cutting knife;

an associated holding location on the support surface to receive the at least one cutting knife; and a clamp member having a clamping surface to engage and hold the at least one cutting knife in the associated holding location, the improvement comprising:

the clamp member being mountable to the support surface at a pivot joint for pivotal movement of the clamp member with respect to the support surface, the clamping surface of the clamp member extending on one side of the pivot joint and the clamp member having a lever arm extending on the other side of the pivot joint; and an actuating member to apply a force to the lever arm so that a clamping force is applied to the at least one cutting knife by the clamping surface according to the principle of a first order lever in which the clamping force exerted by the clamping surface at the at least one cutting knife is governed by the formula $$F_{clamp} = F_{applied}\left(\frac{D}{d}\right)$$

where $F_{applied}$=the applied force $F_{clamp}$=the clamping force

D=perpendicular distance of the applied force's line of action from the pivot joint d=perpendicular distance of the clamping force's line of action from the pivot joint.

2. Apparatus as claimed in claim 1 in which the pivot joint is defined by a channel and flange formed on the clamp member and a corresponding channel and flange formed on the support surface, the flange of one engaging in the channel of the other.

3. Apparatus as claimed in claim 1 in which the lever arm of the clamp member is formed with a threaded aperture therethrough and the actuating member comprises a fastener threadable through the aperture to bear against the support surface.

4. Apparatus as claimed in claim 1 in which the support surface is formed with a threaded aperture therethrough and the actuating member comprises a fastener threadable through the aperture to bear against the lever arm of the clamp member.

5. Apparatus as claimed in claim 1 in which the actuating member comprises a wedge member positioned between the support surface and the lever arm of the clamp member.

6. Apparatus as claimed in claim 1 in which the actuating member comprises a resilient sealed enclosure in communication with a pressure source positioned between the support surface and the lever arm of the clamp member, the sealed enclosure being expandable by controlled introduction of fluid under pressure into the enclosure to apply a force to the lever arm.

7. Apparatus as claimed in claim 1 in which the actuating member comprises a spring biasing member positioned between the support surface and the lever arm of the clamp member to apply a biasing force to move the arm so that a clamping force is applied to the at least one cutting knife.

8. Apparatus as claimed in claim 7 in which the spring biasing member is a coil spring.

9. Apparatus as claimed in claim 7 in which the spring biasing member is at least one spring washer.

10. Apparatus as claimed in claim 7 including a release member adapted to draw the lever arm toward the support surface against the biasing force of the spring biasing member in order to release the clamping force.

11. Apparatus as claimed in claim 10 in which the release member comprises a threaded fastener extending between the support surface and the lever arm and being threadably engagable into the lever arm.

12. Apparatus as claimed in claim 1 in which the actuating member is a cam member positioned between the support surface and the lever arm of the clamp member.

13. A knife clamping system for holding a cutting knife in position against a support surface comprising:

a clamp member having a clamping surface to engage and hold the cutting knife against the support surface;

a mounting location on the support surface to receive the clamp member, the mounting location and the clamp member co-operating to form a pivot joint for pivotal movement of the clamp member with respect to the support surface, the clamping surface of the clamp member extending on one side of the pivot joint and the clamp member having a lever arm extending on the other side of the pivot joint; and an actuating member to apply a force to the lever arm so that a clamping force is applied to the cutting knife by the clamping surface according to the principle of a first order lever in which the clamping force exerted by the clamping surface at the at least one cutting knife is governed by the formula $$F_{clamp} = F_{applied}\left(\frac{D}{d}\right)$$

where $F_{applied}$=the applied force $F_{clamp}$=the clamping force

D=perpendicular distance of the applied force's line of action from the pivot joint d=perpendicular distance of the clamping force's line of action from the pivot joint.

14. Apparatus as claimed in claim 13 in which the lever arm of the clamp member is formed with a threaded aperture therethrough and the actuating member comprises a fastener threadable through the aperture to bear against the support surface.

15. Apparatus as claimed in claim 13 in which the support surface is formed with a threaded aperture therethrough and the actuating member comprises a fastener threadable through the aperture to bear against the lever arm of the clamp member.

16. Apparatus as claimed in claim 13 in which the actuating member comprises a wedge member positioned between the support surface and the lever arm of the clamp member.

17. Apparatus as claimed in claim 13 in which the actuating member comprises a resilient sealed enclosure in communication with a pressure source positioned between the support surface and the lever arm of the clamp member, the sealed enclosure being expandable by controlled introduction of fluid under pressure into the enclosure to apply a force to the lever arm.

18. Apparatus as claimed in claim 13 in which the actuating member comprises a spring biasing member positioned between the support surface and the lever arm of the clamp member to apply a biasing force to move the arm so that a clamping force is applied to the at least one cutting knife.

19. Apparatus as claimed in claim 18 in which the spring biasing member is a coil spring.

20. Apparatus as claimed in claim 18 in which the spring biasing member is at least one spring washer.

21. Apparatus as claimed in claim 18 including a release member adapted to draw the lever arm toward the support surface against the biasing force of the spring biasing member in order to release the clamping force.

22. Apparatus as claimed in claim 21 in which the release member comprises a threaded fastener extending between the support surface and the lever arm and being threadably engagable into the lever arm.

23. Apparatus as claimed in claim 13 in which the actuating member is a cam member positioned between the support surface and the lever arm of the clamp member.

* * * * *